US007287460B2

(12) United States Patent
Riley et al.

(10) Patent No.: US 7,287,460 B2
(45) Date of Patent: Oct. 30, 2007

(54) HYDRAULIC RETENTION SYSTEM FOR RECIPROCATING PUMP CYLINDER LINER

(75) Inventors: Andrew Dale Riley, Eufaula, OK (US); Randall Ferrain Weaver, Haywood, OK (US)

(73) Assignee: National-Oilwell Varco, L.P., Houston, TX (US)

( * ) Notice: Subject to any disclaimer, the term of this patent is extended or adjusted under 35 U.S.C. 154(b) by 769 days.

(21) Appl. No.: 10/691,832

(22) Filed: Oct. 23, 2003

(65) Prior Publication Data

US 2005/0089427 A1 Apr. 28, 2005

(51) Int. Cl.
*F16J 10/04* (2006.01)

(52) U.S. Cl. ..... 92/171.1

(58) Field of Classification Search ..... 92/171.1; 29/888.061

See application file for complete search history.

(56) References Cited

U.S. PATENT DOCUMENTS

| | | | |
|---|---|---|---|
| 2,845,313 | A | 7/1958 | Benson et al. |
| 2,963,984 | A | 12/1960 | Rogers |
| 3,438,334 | A | 4/1969 | Schaaf |
| 3,610,110 | A | 10/1971 | Schaaf |
| 3,635,616 | A | 1/1972 | Venkalesan |
| 3,786,729 | A | 1/1974 | Rizzone |
| 4,453,454 | A | 6/1984 | Comer |
| 4,486,938 | A | 12/1984 | Hext |
| 4,550,646 | A | 11/1985 | Miller |
| 5,307,915 | A | 5/1994 | Grosspietsch et al. |
| 5,359,824 | A | 11/1994 | Koberstein |
| 5,572,920 | A | 11/1996 | Kennedy et al. |
| 5,616,009 | A | 4/1997 | Birdwell |
| 6,209,445 | B1 | 4/2001 | Roberts |
| 6,588,318 | B2 | 7/2003 | Aday et al. |
| 2002/0159823 | A1 | 10/2002 | Aday et al. |

*Primary Examiner*—F. Daniel Lopez
(74) *Attorney, Agent, or Firm*—Conley Rose, P.C.

(57) ABSTRACT

Methods and apparatus for securing a cylinder liner to a pump module. A tension body is disposed about the cylinder liner and attached to the pump module. A locking body engages the cylinder liner and is threaded to the tension body. A hydraulic load cell is removably attached to the tension body and includes a hydraulic ram arranged to impart a compressive load to the cylinder liner and a tension load in the tension body. The locking body can be adjusted axially to contact the cylinder liner and maintain the applied loads, which act as a pre-load to keep the cylinder liner in contact with the pump module.

26 Claims, 5 Drawing Sheets

HYDRAULIC RETENTION SYSTEM FOR RECIPROCATING PUMP CYLINDER LINER

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to mud pumps and particularly relates to a system and apparatus for aligning and securing the cylinder liners of such pumps to their respective pumping modules. More particularly, the present invention relates to a hydraulic retention system and apparatus for aligning and securing the cylinder liner that includes a removable pre-loading system.

BACKGROUND

In extracting hydrocarbons from the earth it is common to drill a borehole into the earth formation containing the hydrocarbons. A drill bit is attached to a drill string, including joined sections of drill pipe, suspended from a drilling rig. As the drill bit rotates, the hole deepens and the string is lengthened by attaching additional sections of drill pipe. During drilling operations, drilling fluid, or "mud" as it is also known, is pumped down through the drill pipe and into the hole through the drill bit. Drilling fluids are used to lubricate the drill-bit and keep it cool. The drilling mud also cleans the bit, and balances pressure by providing weight downhole, as well as bringing up to the surface sludge and cuttings created during the drilling process.

Slush or mud pumps are commonly used for pumping the drilling mud. Because of the need to pump the drilling mud through several thousand feet of drill pipe, such pumps typically operate at very high pressures. Moreover, it is necessary for the mud to emerge from the drill bit downhole at a relatively high velocity to lubricate and cool the bit and to effectively remove cuttings from the hole. Lastly, the fluid pressure generated by the mud pump contributes to maintaining a predetermined total downhole pressure, which is necessary in order to prevent dangerous and costly well blowouts.

The pistons and cylinders used for such mud pumps are susceptible to a high degree of wear during use because the drilling mud is relatively dense and has a high proportion of suspended abrasive solids. As the cylinder in which the piston reciprocates becomes worn, the small annular space between the piston head and the cylinder wall increases substantially and sometimes irregularly. This decreases the efficiency of the pump. To reduce the effect of this wear, the cylinder typically is provided with an expendable cylinder liner, which can be easily replaced.

It is the usual practice to replace the cylinder liner at end of its useful life. The pump cylinder liner in a duplex pump typically has an average life of 1200 to 1500 pump hours, or about 90 to 100 days. A duplex pump has two reciprocating pistons that each force fluid into a discharge line. The average life of the cylinder liners in a triplex pump is about 500 to 900 hours or about 50 to 60 days of service life at a normal duty cycle. Triplex reciprocating pumps have three pistons that force fluid into a discharge line. These fluid pumps can be single acting, in which fluid is discharged on alternate strokes, or double acting, in which each stroke discharges fluid.

In the course of installing or replacing a cylinder liner, the cylinder liner may become misaligned. Misaligned contact between the metal piston head and the cylinder creates considerable friction, abrasion, and heat. This, in turn, causes the cylinder liner, as well as other various pump parts, such as seals, to be susceptible to an increased rate of wear. In some cases, the frictional forces may even cause the seal to detach from the piston. For these reasons, the alignment of the cylinder liner of such pumps is critical.

Further, changing a cylinder liner in a mud pump is typically a difficult, dirty, and heavy job. Still further, because drilling rig time is very expensive, frequent replacement of cylinder liners causes considerable inconvenience if the system and apparatus for releasing the old cylinder liners and fitting the replacement cylinder liners are slow or difficult to operate. Thus, it is important that the system and method for aligning and securing the cylinder liners may be implemented without undue effort and down-time.

Some original pump designs include a large threaded "hammer nut" that is hammered on and off to hold the liner in place. Such a system for securing cylinder liners to respective pumping modules is difficult to operate with precision for a variety of reasons, including the involvement of heavy components, the handling of which may be dangerous for operators. These types of systems require considerable strength, skill and reliability of operators, together with the use of heavy tools in confined spaces. Thus, it is difficult to apply a specified torque to within a desired preset tolerance. Further, the securing force is dependent on the extent of wear and the general condition of the securing components.

There are several alternative ways to attach cylinder liners to their respective pumping modules, and these may vary according to make of pump in which they are used. One embodiment presently known employs a tapered concentric clamp, while another uses a concentric screw clamping arrangement. The tapered clamp is susceptible to corrosion and wear, which diminish its effectiveness. Other pump designs require large wrenches or impact socket tools to remove large nuts from studs so as to release the retainer. Not only is this not as precise way to load the liner seal, but in some models the rotation effect can dislodge and fail the seal mechanism. In all of these systems, the force securing the cylinder liner is difficult to control precisely, causing the cylinder liner to be susceptible to misalignment.

In still another known design, a replacement device involves removal of some of the original parts and uses hydraulics and Belleville washers to load, hold, and restrain the liner. This system relies on a spring lock, and therefore the securing force is dependent on the ability of the spring to retain its stiffness against the securing components. In addition, it relies on nuts secured on studs spaced about the circumference of the cylinder. Thus, this system causes the cylinder liner to be susceptible to misalignment arising from unequal securing forces at each stud, which can be caused by unequal tightening of each nut.

Accordingly, there remains a need to develop a new and improved system and apparatus for retaining and replacing a cylinder liner which overcomes certain of the foregoing difficulties while providing more advantageous overall results.

SUMMARY OF THE PREFERRED EMBODIMENTS

The embodiments of the present invention are directed to methods and apparatus for securing a cylinder liner to a pump module. A tension body is disposed about the cylinder liner and attached to the pump module. A locking body engages the cylinder liner and is threaded to the tension body. A hydraulic load cell is removably attached to the tension body and includes a hydraulic ram arranged to impart a compressive load to the cylinder liner and a tension load in the tension body. The locking body can be adjusted axially to contact the cylinder liner and maintain the applied loads, which act as a pre-load to keep the cylinder liner in contact with the pump module.

In one embodiment, an assembly for attaching a liner to a pump module comprises a bushing attached to the pump module and a liner having a first end disposed within the bushing and a second end projecting from the bushing. The first end sealingly engages the pump module. An annular shoulder is disposed on the cylindrical liner. A tension body is connected to the bushing and a locking body is threadably engaged with the tension body and has a first end in contact with the annular shoulder so as to maintain the sealing engagement between the liner and the pump module. The assembly may also include a load cell operable to simultaneously apply a compressive load to the liner and a tension load to the tension body. In certain embodiments the assembly may also include a hydraulic body connected to the tension body and a piston disposed within the hydraulic body and operable to engage the second end of the liner and urge the liner into sealing engagement with the pump module.

In an alternate embodiment, a device for securing a liner to a pump module comprises: an alignment member connected to the pump module and engaged with one end of the liner; a tension member extending axially from the bushing; a locking member having a first end threadably engaged with the tension member and a second end in contact with the liner, wherein the locking member is operable to maintain the position of the liner relative to the pump module; a hydraulic member connected to the tension member; and a piston disposed within the hydraulic member and adapted to urge the liner into engagement with the pump module, wherein the piston acts to separate the second end of the locking member from the liner.

A method for securing a liner to a pump module, may include disposing a liner in a bushing connected to the pump module; attaching a tension body to the bushing; adjustably engaging a locking ring to contact the liner; attaching a hydraulic body to the tension body; applying hydraulic pressure to a piston disposed in the hydraulic body so as to compress the liner against the pump module; and adjusting the locking ring to maintain contact with the liner. The method may also include removing hydraulic pressure from the piston; and detaching the hydraulic body from the tension body.

Thus, the present invention comprises a combination of features and advantages that enable it to overcome various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
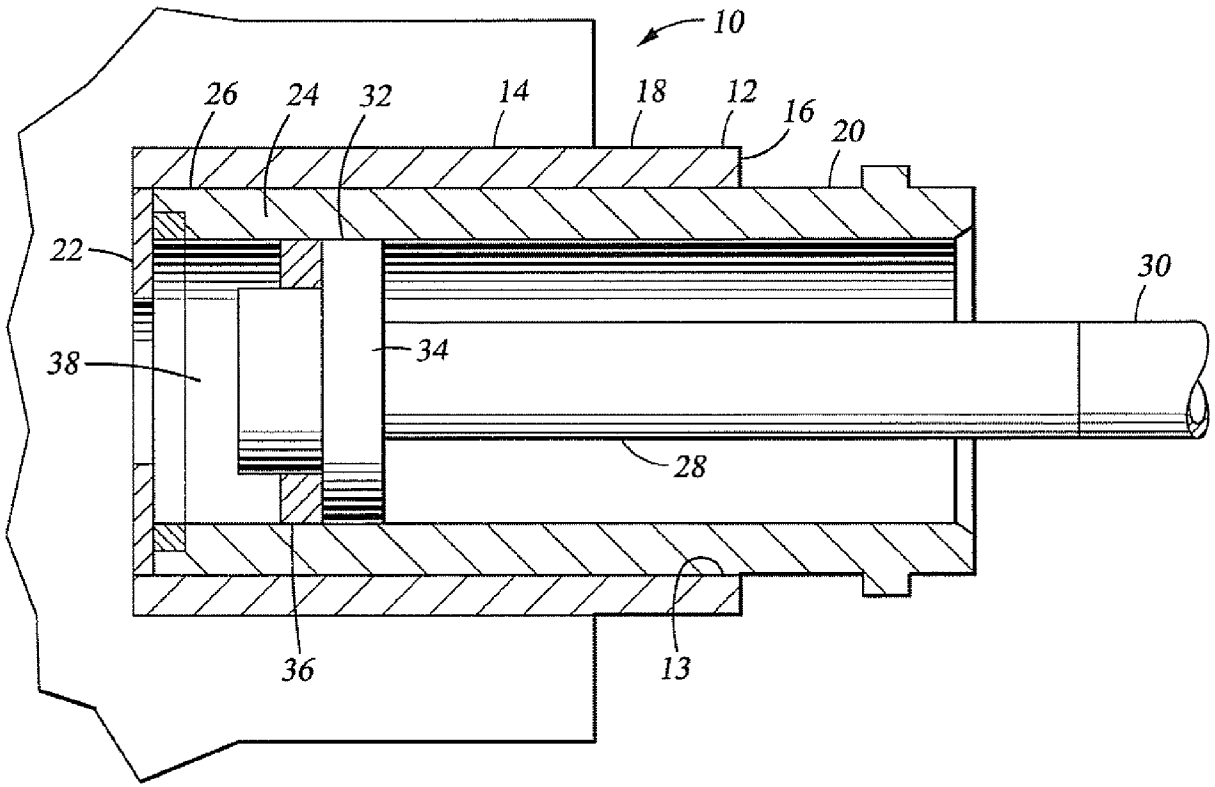
Fig. 1 (PRIOR ART)
FIG. 1 is a cross-sectional view of the fluid end of a conventional pump module.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In particular, various embodiments described herein thus comprise a combination of features and advantages that overcome some of the deficiencies or shortcomings of prior art cylinder liner securing apparatus or systems. The various characteristics mentioned above, as well as other features and characteristics described in more detail below, will be readily apparent to those skilled in the art upon reading the following detailed description of preferred embodiments, and by referring to the accompanying drawings.

Referring to FIG. 1, an exemplary prior art mud pump 10 includes retention member 12. Retention member 12 preferably comprises a substantially cylindrical retention sleeve 14 that includes a front face 16 and an outer surface 18. A cylinder liner 20 is disposed within retention member 12, preferably contacting the inner surface 13 of retention member 12. A wear plate 22 provides a renewable surface for liner 20. A liner seal 26 is preferably positioned between end 24 of cylinder liner 20 and wear plate 22. A piston 28 is disposed within liner 20 and is connected to a rod 30 which, in turn, is connected to a slider crank mechanism (not shown) driven by an electric motor or engine (not shown).

In operation, the piston 28 reciprocates within liner 20. The orientation of the piston 28 may be reversed from that shown in FIG. 1, depending on the configuration of the pump. Between the cylinder liner 20 and the piston 28 is a small annular space 32. The piston 28 includes a piston head 34 having an annular seal 36 is disposed thereon. Seal 36 contacts the inside surface 21 of cylinder liner 20. Pump fluid is located in chamber 38 defined by liner 20, piston 28, and wear plate 22. Chamber 38 is in fluid communication with a passageway (not shown) through a pump manifold (not shown). The pump fluid is pressurized by the movement of the piston head 34 within the liner 20. Seal 36 is provided to seal the annular space 32 and thereby prevent the fluid from leaking behind piston head 34. Seal 36 also preferably helps keep the piston 28 centered so as to maintain the annular space 32 separating piston 28 from cylinder liner 20.

After operation of some duration, piston 28 and liner 20 will become worn, particularly if piston 28 and liner 20 come into contact as a result of misalignment. At some point, the degree of wear will be so great that operation of the pump will be impaired. For this reason, it is desirable to have a liner retention system that is reliable and easy to install, operate, and disassemble.

Figure 2:
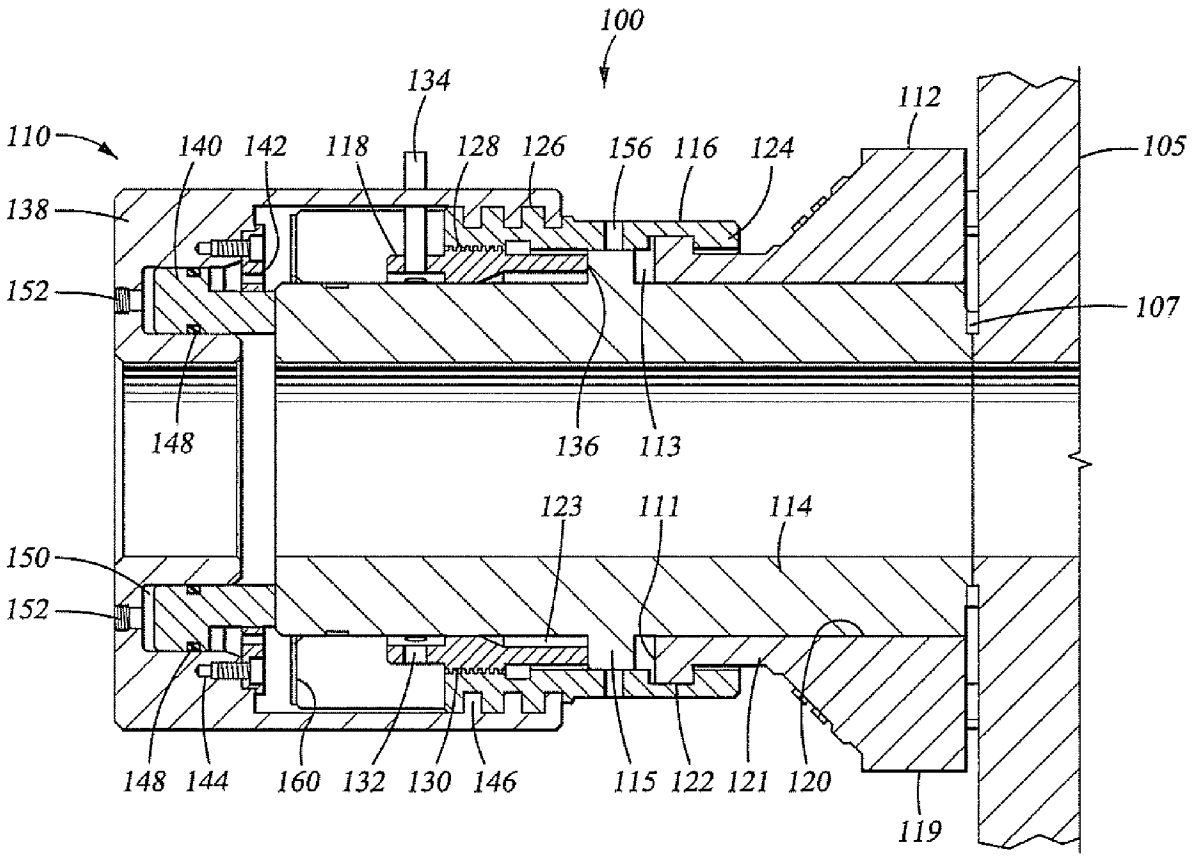
FIG. 2 is a cross-sectional view of one embodiment of a cylinder liner securing system in accordance with one embodiment of the present invention.

Referring now to FIG. 2, one embodiment of a retention apparatus or system 100 includes load cell 110, liner bushing 112, liner body 114, tension body 116, and locking ring 118. Liner bushing 112 is connected to a pump module 105. Seal 107 is disposed between liner body 114 and pump module 105. During operation, it is desired that liner body 114 maintain a compressive load on seal 107 in order to maintain seal energization. One method of maintaining this compressive load is to apply a pre-load to liner body 114 during assembly that is sufficient to maintain a compressive load on seal 107 as the forces acting on liner body 114 change during normal operations.

Bushing 112 includes flange 119, inner bore 120, and neck 121 having an annular shoulder 122. The inner bore 120 of bushing 112 supports and aligns liner body 114 with pump module 105. Liner body 114 is laterally inserted into bushing 112, with a gap 113 maintained between end 111 of bushing 112 and annular shoulder 115 of liner body 114.

Tension body 116 has a substantially cylindrical body with a first end having an inwardly-projecting mating shoulder 124, a middle portion having slots 156 through the body, and a second end having a inner threads 128 and outwardly projecting locking grooves 126. Annular shoulder 122 of bushing 112 engages mating shoulder 124 of tension body 116 forming an annular area 123 between tension body 116 and liner body 114.

Locking ring 118, a substantially cylindrical sleeve member, is disposed in the annular area 123 between tension body 116 and liner body 114. Locking ring 118 has outer threads 130 for engaging threads 128 of tension body 116. Locking ring 118 also has holes 132 on one end that are adapted to accept a bar or handle 134, which can be used to rotate the locking ring. The other end of locking ring 118 has a bearing face 136 that presses against shoulder 115 of liner body 114.

Load cell 110 includes hydraulic body 138, piston 140, retainer 142, and springs 144. Hydraulic body 138 has one end for receiving piston 140, an elongate body 139 including windows 160, and inwardly projecting locking tabs 146 that interface with locking grooves 126. Piston 140 includes seals 148 that create a hydraulic chamber 150 between the piston and hydraulic body 138. Pressurized fluid can be injected into chamber 150 through ports 152 to move piston 140 outward to contact liner body 114.

Figure 3:
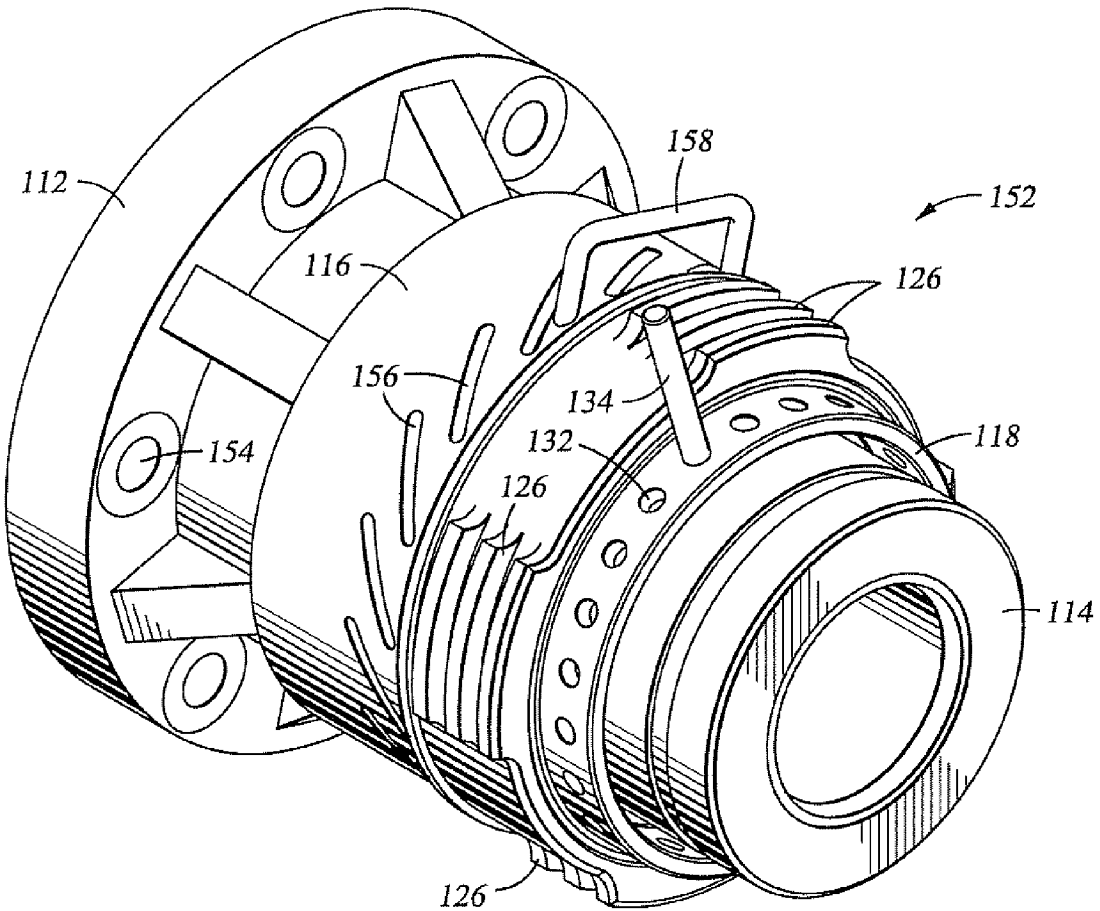
FIG. 3 is an isometric view of a sub-assembly of the securing system of FIG. 2.

Referring now to FIG. 3, a perspective view of an assembly 152 is shown, including liner bushing 112, liner body 114, tension body 116, and locking ring 118. Bar 134 engages holes 132 on locking ring 118 to provide leverage for rotating the ring. Bolt pattern 154 on liner bushing 112 enables the bushing to be connected to a pump module (not shown). Tension body 116 may include handle 158, which can be used to rotate the tension body into engagement with liner bushing 114 and maintain the position of the tension body while locking ring 118 is being rotated. FIG. 3 also illustrates one arrangement of locking grooves 126 on tension body 116. Locking grooves 126 are intermittently, and preferably equally, spaced around tension body 116.

Tension body 116 may include slots 156, which serve to decrease the stiffness of the tension body, and thus lessen its resistance to elongating when loaded. By decreasing the stiffness of tension body 116, the distribution of the pre-load can be more closely controlled, which allows for a more consistent application of the pre-load force. Once pre-loaded, tension body 116 then acts as a spring, forcing locking ring 118 against liner body 114 and maintaining the engagement of the liner body and the pump module. It is understood that any arrangement of slots, holes, or other aperture geometry could be similarly utilized to alter and control the stiffness of a tension body, and that a tension body without any stiffness controlling features could also be used.

Figure 4:
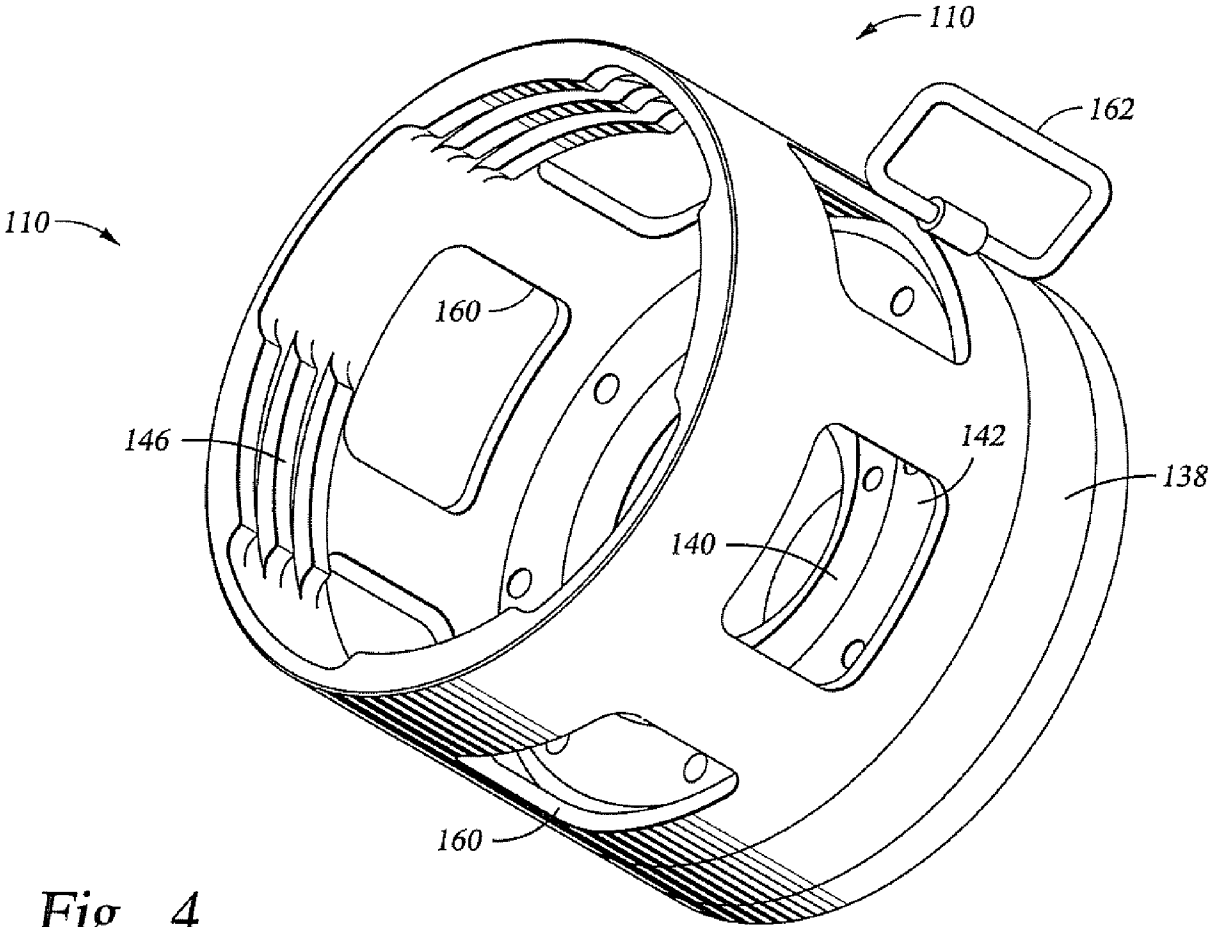
FIG. 4 is an isometric view of the load cell of FIG. 2.

Referring now to FIG. 4, load cell 110 is shown, including hydraulic body 138, piston 140, and retainer 142. Hydraulic body 138 includes locking tabs 146, windows 160, and handle 162. Locking tabs 146 are arranged to interface with locking grooves 126 of tension body 116, which are shown in FIG. 3. To assembly load cell 110 and tension body 116, the load cell is rotated so that locking tabs 146 align with the spaces between locking grooves 126. Load cell 110 is slid laterally over tension body 116 until tabs 146 and grooves 126 align and then rotated until the tabs and the grooves engage.

Figure 5:
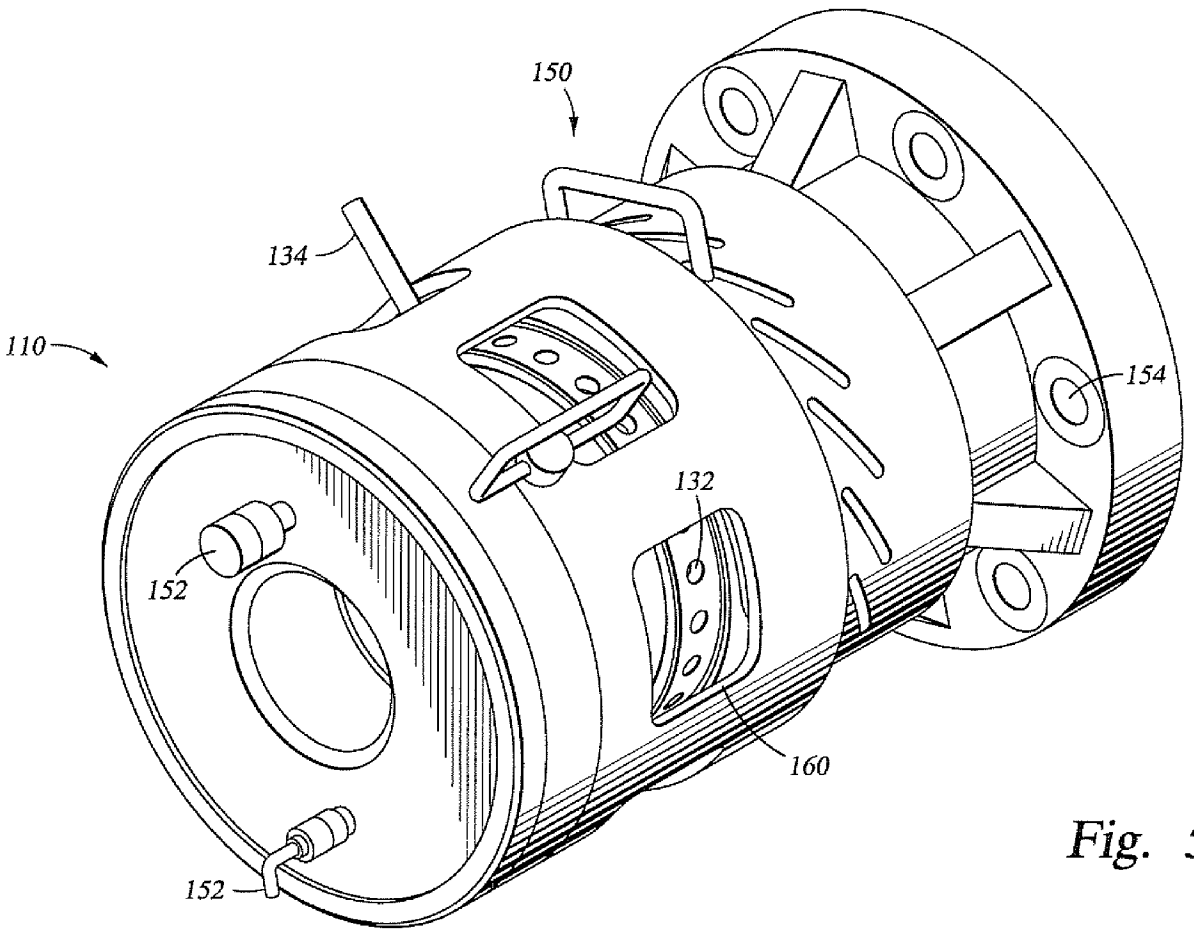
FIG. 5 is an isometric view of the cylinder liner securing system of FIG. 2.

Load cell 110 is shown installed with assembly 156 in FIG. 5. Windows 160 provide access to holes 132 for bar 134 and allow for observation of the engagement of tabs 146 and grooves 126. Windows 160 also allow observation of the extension of piston 140 and its engagement with liner body 114.

Referring again to FIG. 2, once load cell 110 has been assembled onto tension body 116, hydraulic pressure can be applied to chamber 150 through ports 152. This hydraulic pressure urges piston 140 against the end of liner body 114. The extension of piston 140 applies a compressive load that pushes liner body 114 into the pump module. The attachment of load cell 110 to tension body 116 creates a corresponding tension load in the tension body, causing tension body 116 to stretch. The stretching of tension body 116 separates face 136 of locking ring 118 from shoulder 115. Locking ring 118 can then be rotated along threads 128 to maintain the contact between the face and the shoulder. As shown in FIG. 5, bar 134 can be inserted through a window 160 and into one of holes 132 to provide a lever suitable for rotating locking ring 118.

The pressure in chamber 150 can be monitored to determine when the desired pre-load force has been applied to liner body 114. Piston 140 provides a pressure area that allows a relatively low pressure applied to the piston to generate a large force. Therefore, when compared to previous hydraulic systems, a lower pressure can be used to generate the same pre-load force. This allows lower pressure hydraulic systems to be used in assembling the pump components. In certain embodiments, chamber 150 may be fitted with a pressure relief valve to limit the pressure in the chamber.

Once the desired pre-load is achieved, pressure can be released from chamber 150 and springs 144 will retract piston 140. Load cell 110 can then be removed from tension body 116. The loads in tension body 116 and liner body 114 are maintained by threads 130 holding locking ring 118 in bearing engagement against shoulder 115. Thus, the pre-load on seal 107 is maintained by a positive mechanical engagement.

Liner body 114 can disassembled from the pump module by reversing the installation procedure. First, load cell 110 is installed and used to apply a load to liner body 114, as described above. The application of this load allows locking ring 118 to be loosened and removed along with tension body 116 and liner body 114. In certain embodiments, locking ring 118 can be disengaged from tension body 116, allowing liner body 114 to be removed while the tension body 116 remains installed.

While preferred embodiments of this invention have been shown and described, modifications thereof can be made by one skilled in the art without departing from the scope or teaching of this invention. The embodiments described herein are exemplary only and are not limiting. For example, the relative dimensions of various parts, the materials from which the various parts are made, and other parameters can be varied, so long as the hydraulic retention system and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. An assembly for attaching a liner to a pump module, the assembly comprising:

a bushing attached to the pump module;

a liner having a first end disposed within said bushing and a second end projecting from said bushing, wherein the first end sealingly engages the pump module;

an annular shoulder on said cylindrical liner;

a tension body connected to said bushing;

a locking body threadably engaged with said tension body and having a first end in contact with said annular shoulder so as to maintain the sealing engagement between said liner and the pump module; and a load cell operable to simultaneously apply a compressive load to said liner and a tension load to said tension body.

2. The assembly of claim 1 wherein said load cell comprises:

a hydraulic body releasably connected to said tension body; and a piston sealingly engaged with said hydraulic body and operable to compress said liner against the pump module.

3. The assembly of claim 2 wherein said piston can be observed from outside said load cell.

4. The assembly of claim 2 wherein said locking body can be rotated while said load cell is connected to said tension body.

5. An assembly for attaching a liner to a pump module, the assembly comprising:

a bushing attached to the pump module;

a liner having a first end disposed within said bushing and a second end projecting from said bushing, wherein the first end sealingly engages the pump module;

an annular shoulder on said cylindrical liner;

a tension body connected to said bushing;

a locking body threadably engaged with said tension body and having a first end in contact with said annular shoulder so as to maintain the sealing engagement between said liner and the pump module;

a hydraulic body connected to said tension body; and a piston disposed within said hydraulic body and operable to engage the second end of said liner and urge said liner into sealing engagement with the pump module.

6. The assembly of claim 5 wherein said hydraulic body is detachably connected to said tension body.

7. The assembly of claim 5 wherein said locking body is accessible through a plurality of windows through said hydraulic body.

8. An assembly for attaching a liner to a pump module, the assembly comprising:

a bushing attached to the pump module;

a liner having a first end disposed within said bushing and a second end projecting from said bushing, wherein the first end sealingly engages the pump module;

an annular shoulder on said cylindrical liner;

a tension body connected to said bushing;

a locking body threadably engaged with said tension body and having a first end in contact with said annular shoulder so as to maintain the sealing engagement between said liner and the pump module; and a plurality of apertures through said tension body.

9. A device for securing a liner to a pump module, the device comprising:

a bushing connected to the pump module and engaged with one end of the liner;

a tension member extending axially from said bushing;

a locking member having a first end threadably engaged with said tension member and a second end in contact with the liner, wherein said locking member is operable to maintain the position of the liner relative to the pump module;

a hydraulic body connected to said tension member;

a piston disposed within said hydraulic body and adapted to urge the liner into engagement with the pump module, wherein said piston acts to separate the second end of said locking member from the liner.

10. The device of claim 9 wherein said hydraulic body is detachably connected to said tension member.

11. The device of claim 9 wherein said locking member is accessible through a plurality of windows through said hydraulic body.

12. The device of claim 9 further comprising a plurality of apertures through said tension member.

13. A method for securing a liner to a pump module, the method comprising:

disposing a liner in a bushing connected to the pump module;

attaching a tension body to the bushing;

adjustably engaging a locking ring to contact the liner;

attaching a hydraulic body to the tension body;

applying hydraulic pressure to a piston disposed in the hydraulic body so as to compress the liner against the pump module; and adjusting the locking ring to maintain contact with the liner.

14. The method of claim 13 further comprising:

removing hydraulic pressure from the piston; and detaching the hydraulic body from the tension body.

15. The method of claim 13 further comprising:

attaching the hydraulic body to the tension body;

applying hydraulic pressure to a piston disposed in the hydraulic body so as to compress the liner against the pump module;

disengaging the locking ring from the tension body; and removing the liner from the bushing.

16. The method of claim 14 wherein the locking ring is adjusted by hand.

17. The method of claim 13 wherein a tension load is applied to the tension body by the hydraulic body as hydraulic pressure is applied to the piston.

18. An apparatus for applying a pre-load to the engagement between a liner body and a pump module, the apparatus comprising:

a load cell having a hydraulic piston operable to apply a load compressing the liner body against the pump module;

a locking member adapted to engage the liner body while the load is applied and maintain the position of the liner body when the load is removed; and a tension body connected between the pump module and said load cell such that said tension body is tensioned as the liner body is compressed against the pump module.

19. The apparatus of claim 18 wherein said load cell is removably connected to said tension body.

20. The apparatus of claim 18 wherein said locking member threadably engages said tension body.

21. The apparatus of claim 18 wherein said load cell comprises:

a first end supporting the hydraulic piston;

a cylindrical wall extending from said first end; and a second end having inwardly extending tabs adapted to engage said tension body.

22. The apparatus of claim 21 further comprising one or more windows through said cylindrical wall.

23. The apparatus of claim 18 wherein said tension body comprises:

a first end connected to the pump module;

a cylindrical wall extending from said first end; and a second end having an internal threaded surface and outwardly projecting grooves adapted to engage said load cell.

24. The apparatus of claim 23 wherein the cylindrical wall of said tension body further comprises a plurality of apertures therethrough.

25. The apparatus of claim 18 further comprising a bushing adapted to align the liner body and the pump module.

26. The apparatus of claim 25 wherein said bushing is adapted to connect said tension body to the pump module.

* * * * *